US006179502B1

(12) United States Patent
Gray

(10) Patent No.: US 6,179,502 B1
(45) Date of Patent: Jan. 30, 2001

(54) WRITING INSTRUMENT WITH LOCKING CORE

(75) Inventor: Terry A. Gray, Versailles, MO (US)

(73) Assignee: Dixon Ticonderoga Company, Heathrow, FL (US)

( * ) Notice: Under 35 U.S.C. 154(b), the term of this patent shall be extended for 0 days.

(21) Appl. No.: 09/247,598

(22) Filed: Feb. 10, 1999

(51) Int. Cl.[7] ..... B43K 19/16; B43K 19/18
(52) U.S. Cl. ..... 401/96
(58) Field of Search ..... 401/96, 88, 49, 401/DIG. 3

(56) References Cited

U.S. PATENT DOCUMENTS

| | | | | |
|---|---|---|---|---|
| 43,391 | | 7/1864 | Cleveland . | |
| 551,288 | | 12/1895 | Kaiser . | |
| 972,624 | | 10/1910 | Kaiser . | |
| 2,075,223 | * | 3/1937 | Pischel | 401/96 |
| 2,107,816 | * | 2/1938 | Chesler | 401/96 |
| 2,131,657 | * | 9/1938 | Ferst | 401/96 |
| 2,231,410 | | 2/1941 | Kern et al. | 120/83 |
| 2,319,585 | * | 5/1943 | Chesler | 401/96 |
| 3,086,903 | * | 4/1963 | Grossman | 156/273 |
| 5,549,779 | | 8/1996 | Stoecklein | 156/293 |

FOREIGN PATENT DOCUMENTS

| | | | | |
|---|---|---|---|---|
| 78288 | * | 7/1918 | (CH) | 401/96 |
| 598024 | | 4/1978 | (CH) . | |
| 12446 | | 5/1986 | (GB) . | |

* cited by examiner

*Primary Examiner*—Charles R. Eloshway
(74) *Attorney, Agent, or Firm*—Fitzpatrick, Cella, Harper and Scinto

(57) ABSTRACT

A writing instrument and a process for manufacturing thereof, a core having a configuration with includes a plurality of channels spaced apart in a radial direction. The channels have sides which form a specific minimum angle at the centerline of each channel. The writing instrument also includes a pair of slats, each having a configuration corresponding to approximately half of the configuration of the core.

13 Claims, 5 Drawing Sheets

WRITING INSTRUMENT WITH LOCKING CORE

FIELD OF THE INVENTION

The present invention relates to writing instruments, in particular to color pencils and processes for making color pencils, having a core configured to mechanically lock with a slat having a corresponding configuration.

BACKGROUND OF THE INVENTION

As shown in FIGS. 1A and 1B, pencils are generally made up of a round pencil core 2 surrounded by an outer casing of wood or other material. The outer casing includes an upper section 6 and a lower section 4, with an adhesive layer 8 to bind the upper and lower section. During mass production of pencils, upper 10 and lower 12 slats are used, which have multiple grooves 3*a* in slat 10 and 3*b* in slat 12. Pencil cores are placed in the grooves of the lower slat and the upper slat is placed on the lower slat to form the upper and lower section of the pencil casing, respectively. To bond the cores to the slats and the slats to one another, an adhesive is generally used along each channel and at the bonding surface 8 between the two slats. The combination of slats and pencil cores is referred to as a "sandwich."

The bonded slats are then cut into individual pencils in any variety of outer casing styles. These styles are well known and include round and polygonal cross-sections, as shown by the hexagonal outline 14 shown in FIG. 1B.

With colored pencils, because the core is made from waxes, it is difficult to manufacture pencils such that the core remains in the pencil casing and does not rotate. Even with the use of adhesives, color cores often rotate and slide within the pencil casing. Moreover, the methods used to secure the core in the pencil casing should be amenable to mass produced, commercial manufacture of writing instruments.

Previous methods to secure a core to the slat have included both mechanical and chemical means used in conjunction (generally) with an adhesive. Prior mechanical methods of attachment relied on a variety arrangements. For example, as shown in Great Britain Patent 12,446, a series of thin angular ribs or flutes running the length of the core and projecting up from the surface thereof were pressed into wooden slats. The formation of the thin ribs disclosed by this reference is not amenable to modern commercial production methods. Swiss Patent 598,288 discloses a ribbed core held between two plastic by a clamping device. U.S. Pat. No. 551,288 discloses a lower slat having a deep groove for containing an entire pencil core. An upper slat caps off the lower slat and is wedged between the sides of the exposed core to restrain the core in place. In addition, an adhesive is used to restrain the core.

Chemical means, used in conjunction with adhesive, usually involve treatment of the core to allow it to better adhere to the wood slat. These treatments involve the modification of the greasy surface of a color core, to render the surface suitable for bonding with the adhesive. Examples of chemical means are disclosed in U.S. Pat. Nos. 1,892,508, 1,958,194, and 2,116,217. None of these previous methods have been entirely successful.

Thus, there is a need to design a cost efficient pencil having a core that is joined to a pencil slat in a manner that the core does not become displaced and does not rotate within the slat, and without the need of an adhesive.

SUMMARY AND OBJECTS OF THE INVENTION

In one aspect of the present invention, a writing instrument includes a core having a configuration with a plurality of channels spaced apart in a radial direction. The channels include sides which form an angle of at least 90 degrees at the centerline of each channel. The writing instrument also includes a pair of slats each having a configuration corresponding to approximately half of the configuration of the core.

In another aspect of the present invention, a process for manufacturing a writing instrument includes the steps of preparing a core material having a predetermined moisture content, extruding the core material to produce a core configuration having a plurality of channels spaced apart in a radial direction, preparing a pair of slats each to include a configuration corresponding to approximately half of the configuration of the core, positioning the core between the slats to align the configuration of the core with the configurations of the slats, and pressing together the core and the slats. The channels of the core include sides which form an angle of at least 90 degrees at the centerline of each channel.

In yet another aspect of the present invention, a writing instrument core includes a configuration having a plurality of channels spaced apart in a radial direction, where the channels have sides which form an angle of at least 90 degrees at the centerline of each channel.

In yet another aspect of the present invention, a slat for a writing instrument includes grooves having a configuration spaced apart along a radial direction, where the grooves include sides which form an angle of at least 90 degrees at the centerline of each groove.

In still yet another aspect of the present invention, a pencil includes a core having a configuration that includes a plurality of channels spaced apart in a radial direction, where the channels have sides which form an angle of at least 90 degrees at the centerline of each channel. The channels also include a first channel having a side in a first plane and a second channel having a side in a second plane substantially parallel to the first plane and positioned about 180 degrees in the radial direction from the first channel. The pencil also includes a pair of slats each having a configuration corresponding to approximately half of the configuration of the core.

Therefore, it is an object of the present invention to provide a pencil which overcomes the drawbacks of the prior art.

It is another object of the current invention to provide a pencil having a core that locks into a slat.

It is another object of the current invention to provide a pencil where a core is joined to a pair of slats without the use of an adhesive.

It is another object of the current invention whereby waxy, greasy, color cores are bonded to slats in the manufacture of a pencil.

These and other objects and aspects, and many of the attendant advantages of this invention, will be readily appreciated and better understood by reference to the following detailed description when considered in connection with the accompanying drawings summarized below.

DETAILED DESCRIPTION OF PREFERRED EMBODIMENTS

Figure 1A:
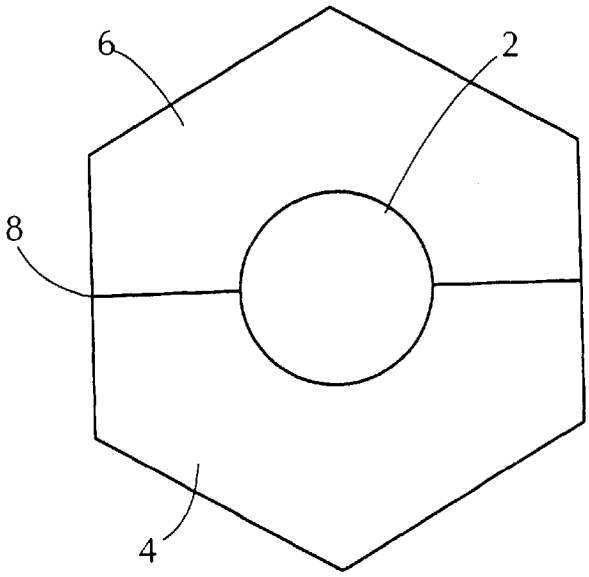
FIG. 1A PRIOR ART
FIG. 1A illustrates a cross-sectional view of a pencil according to the prior art.
Figure 1B:
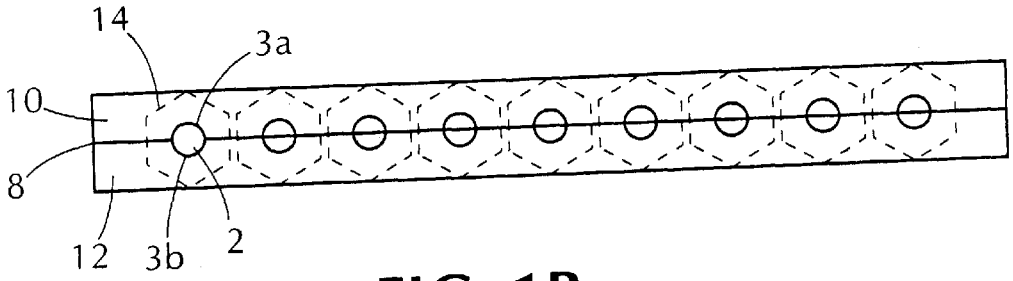
FIG. 1B PRIOR ART
FIG. 1B illustrates a cross-sectional view of a pencil sandwich according to the prior art.
Figure 2A:
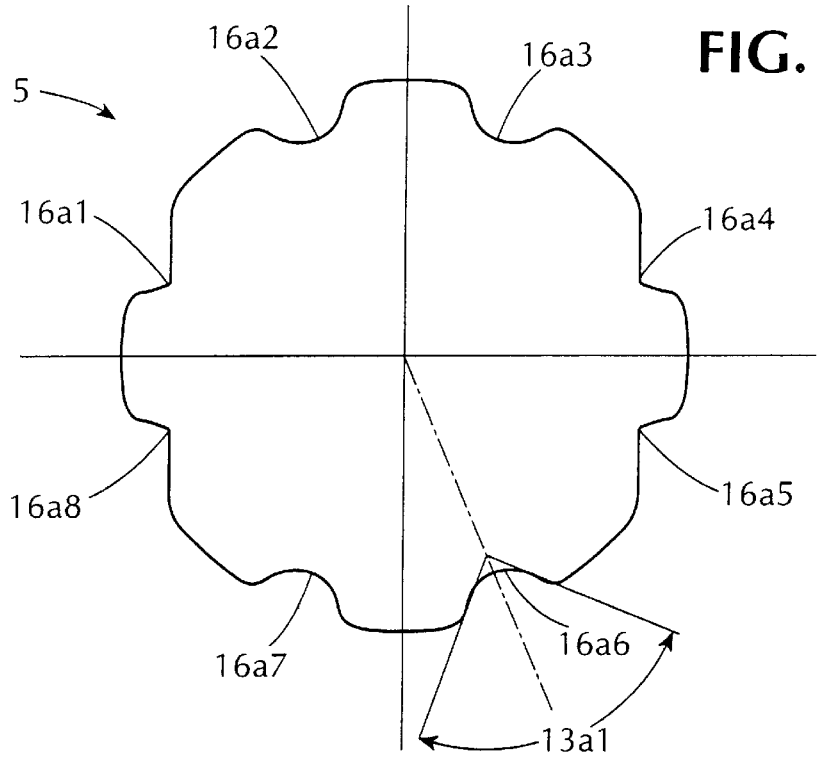
FIG. 2A illustrates a cross-sectional view of a geometric configuration for an eight channel core according to the present invention.
Figure 3A:
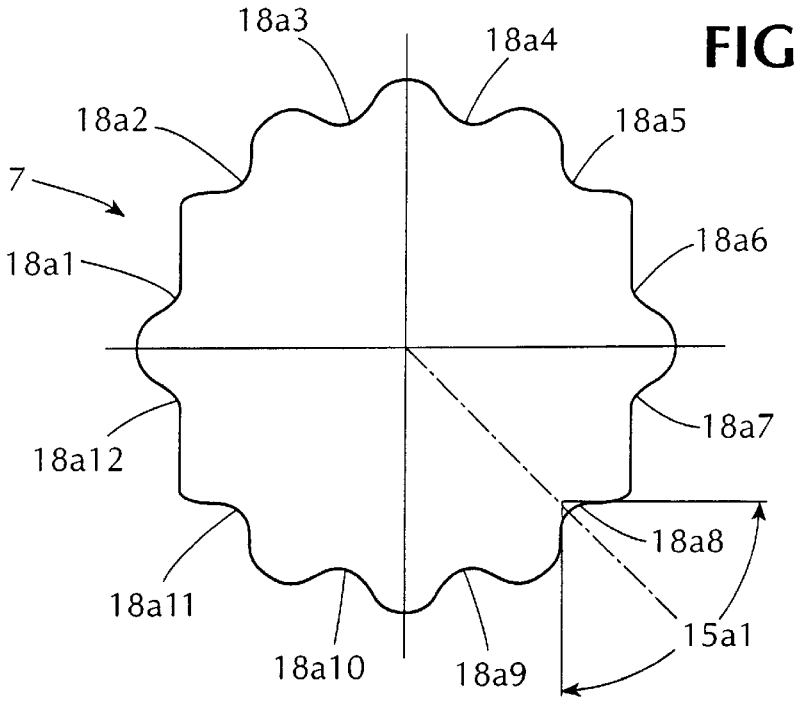
FIG. 3A illustrates a cross-sectional view of a geometric configuration for a twelve channel core according to the present invention.
Figure 2B:
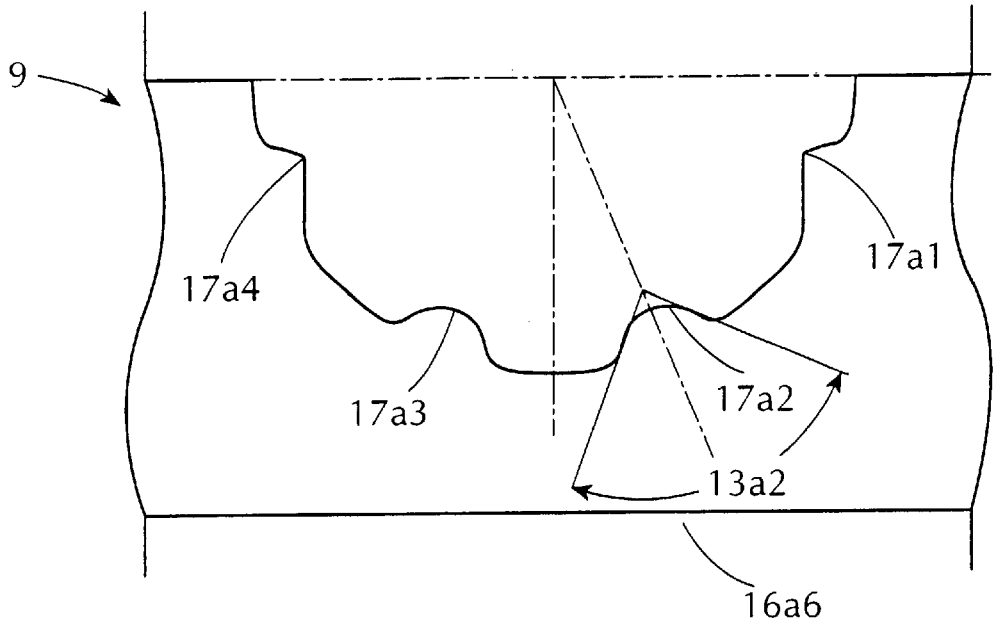
FIG. 2B illustrates a cross-sectional view of a geometric configuration for a groove of a slat for use with the core illustrated in FIG. 2A, according to the present invention.
Figure 3B:
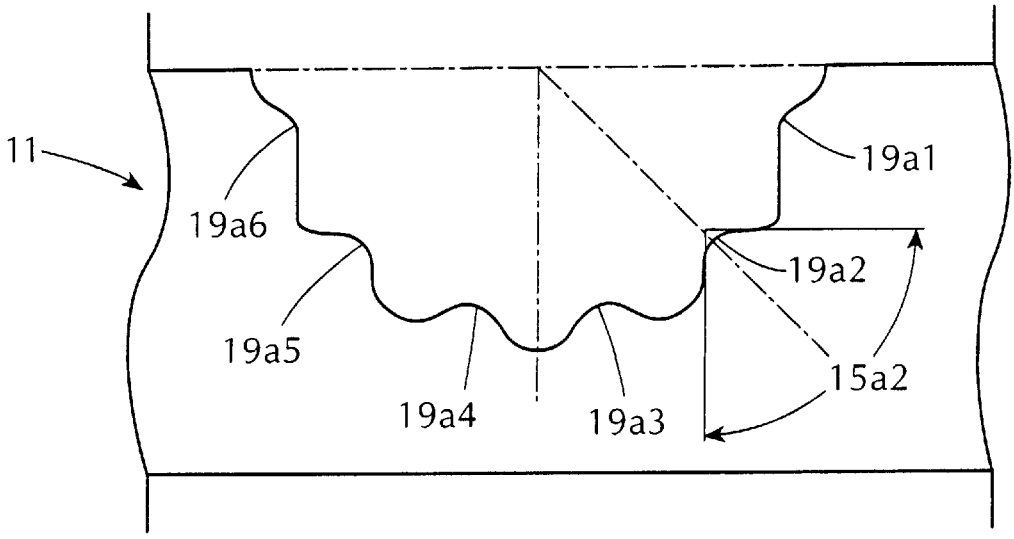
FIG. 3B illustrates a cross-sectional view of a geometric configuration for a groove of a slat for use with the core illustrated in FIG. 3A, according to the present invention.
Figure 4:
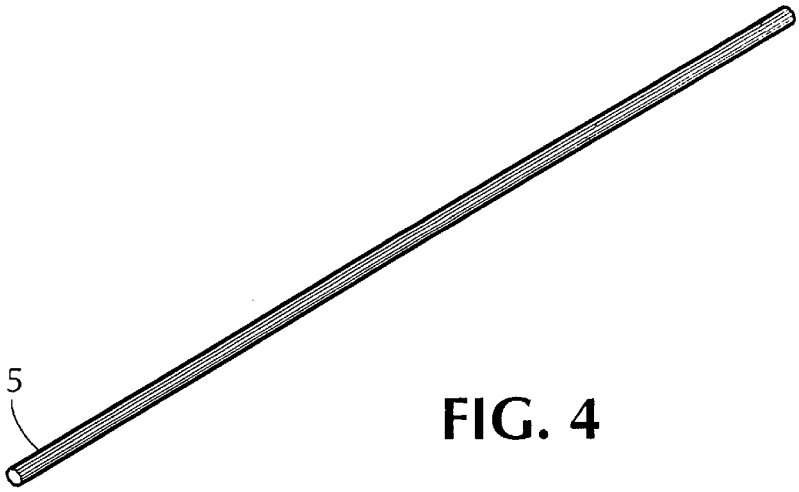
FIG. 4 illustrates a perspective view of a core for a pencil according to the present invention.

FIGS. 2A–B and 3A–B illustrate the cross-sectional views of geometric configurations of a multi-channeled core and multi-grooved slat according to the present invention. FIGS. 2A and 2B relate to a core having eight channels, while FIGS. 3A and 3B relate to a core having twelve channels.

The core material is prepared by mixing pigment, clay, wax, talc and water. A sufficient amount of water is added to equal approximately 20–35% of the dry material weight, preferably between 25–29%, and more preferably to approximately 27%.

For example, to manufacture a yellow core, the following ingredients are mixed:

| | |
|---|---|
| 1240 Yellow Pigment | 7% |
| Unitane 0110 | 3% |
| 399 Talc | 20% |
| Vertal 700 Talc | 20% |
| Carver Clay | 20% |
| Industrine R Wax | 7% |
| 117 Wax | 7% |
| Calcium Stearate | 10% |
| Methocel KYMS | 6% |
| Total: | 100% |

Similarly, to manufacture a red core, the following quantities (in weight) are mixed:

| | |
|---|---|
| 234-6485 Permanent Red Pigment | 14% |
| 399 Talc | 18% |
| Vertal 700 Talc | 17.5% |
| Carver Clay | 16% |
| Industrine R Wax | 18% |
| Calcium Stearate | 10% |
| Methocel KYMS | 6.5% |
| Total: | 100% |

Sufficient water is added to these ingredients such that the moisture content of the final core is about 20–35%, and preferably to about 25–29%, and more preferably to about 27%. The core mixture is then extruded out an extrusion die, which has been machined to produce, for example, the cross-sectional geometric configuration of a core 5 (FIG. 2A) and a core 7 (FIG. 3A) containing a plurality of channels 16*a*1–16*a*8 (FIG. 2) or 18*a*1–18*a*12 (FIG. 3), resembling a reverse spline configuration.

The extrusion die is manufactured of a carbide inserted stainless steel casing, machined, using an Electronic Machining Device (E.D.M.), to within 0.005".

Although the channels can be identical, like those of 16*a*2 and 16*a*3, it is preferable that each geometric configuration include substantially flat parallel channels 16*a*1 and 16*a*4 on one side, corresponding to parallel channels 16*a*5 and 16*a*8 positioned on the other side of the cross-section. Similarly, the twelve channel arrangement may include parallel channels 18*a*1 and 18*a*6, corresponding to parallel channels 18*a*7 and 18*a*2. Although the present invention is described and illustrated using two pair of flat parallel channels, the invention is not so limited to such an arrangement.

Any number of channels can be used, and each channel may be of different cross-sectional shape. Preferably, the invention includes the cross-sectional shapes of FIGS. 2 and 3, used with at least six channels equally spaced radially along the core surface—the number of channels equaling an even number, including 6, 8, 10, 12 or more total channels. An odd number of channels may also be used. In addition, the extrusion die preferably is machined so that sides of a channel of the resultant extruded core form a combined angle 13*a*1 or 15*a*1, with respect to the cross-sectional shapes illustrated in FIGS. 2 and 3, respectively, with the center line of a channel of at least about 90 degrees.

After the cores are extruded, they are dried and monitored for moisture content. Since the resulting major diameter of the core is directly dependent upon the amount of moisture, the moisture content is closely monitored so that it is kept uniform for all core produced with a particular batch of core material.

Figure 5:
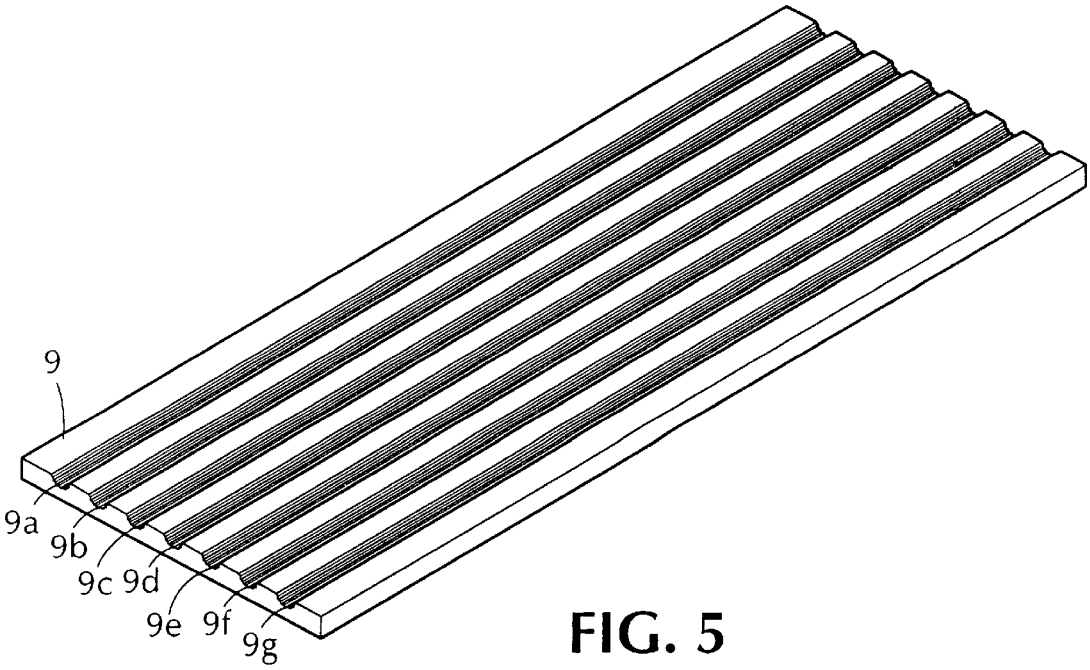
FIG. 5 illustrates a slat to contain multiple cores according to the present invention.
Figure 6:
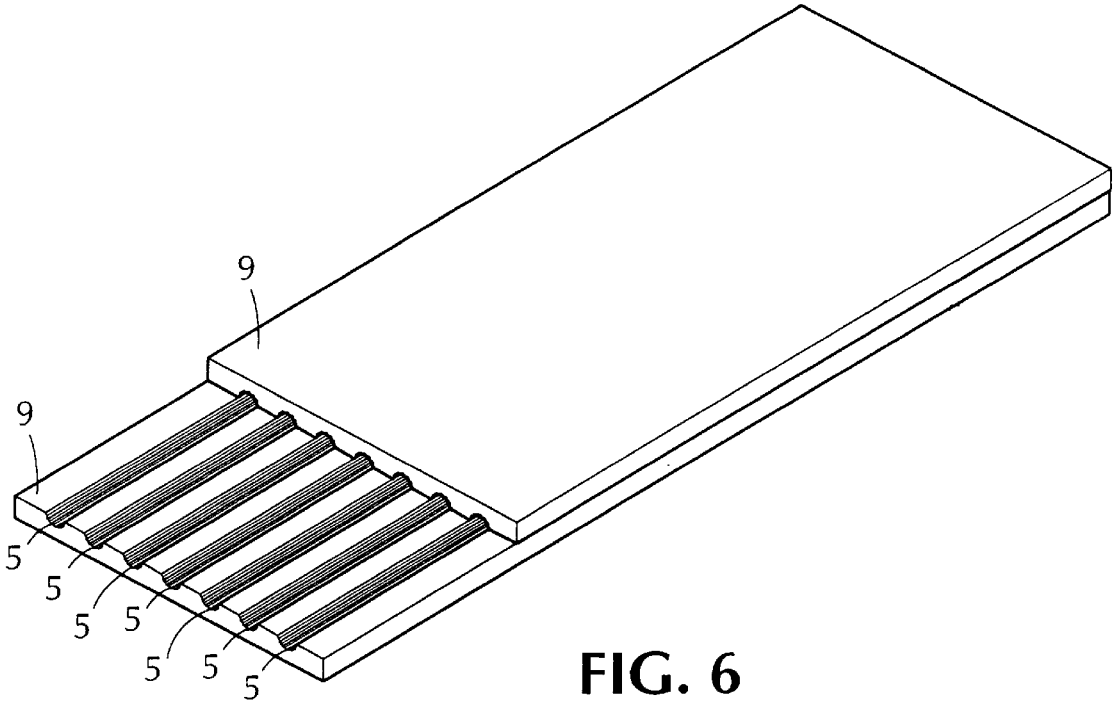
FIG. 6 illustrates a partial cut-away perspective view of multiple pencil cores contained in upper and lower slats according to the present invention.
Figure 7:
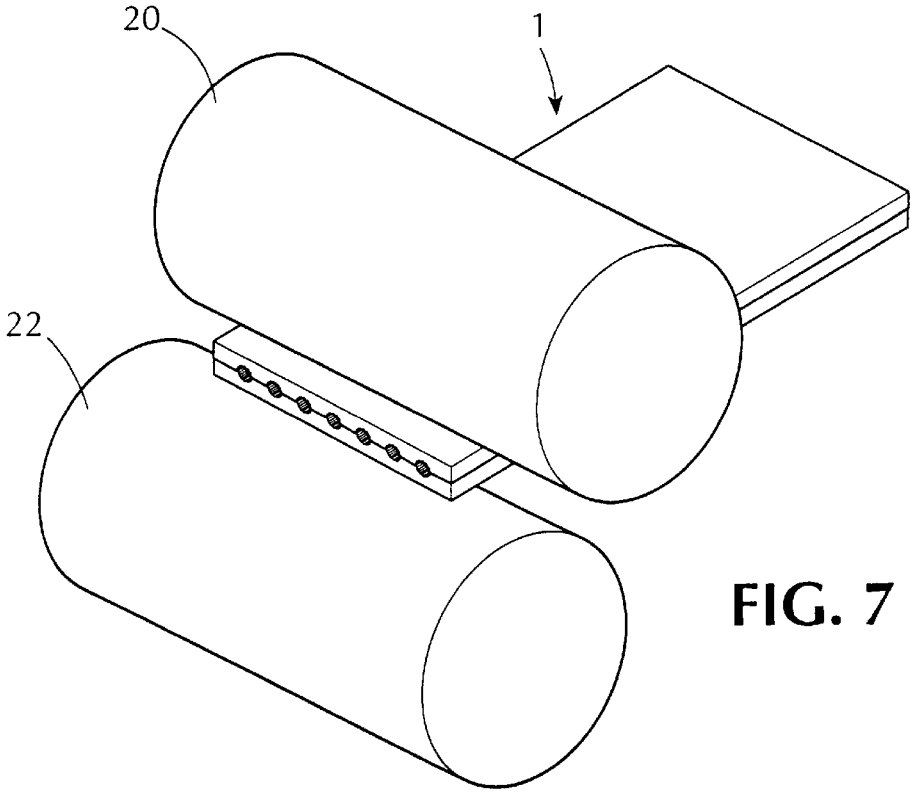
FIG. 7 illustrates a sandwich assembly including upper and lower slats containing multiple cores being locked together in a pressing operation according to the present invention.

The resultant major diameter of a dried core is then measured to determine the size of a cutting blade to be used for cutting at least one substantially identically configured groove, containing half the geometric configuration of the core, within the upper and lower slats. As shown in FIGS. 5 and 6, for purposes of mass production, the slats 9 are capable of holding multiple cores, preferably nine. Although a wood slat is preferable, any material having similar properties can be used to provide a satisfactory pencil casing.

To produce a substantially identical slat having half the geometric configuration of the core, a milling machine produces grooves out of slat material. The grooves are designed to receive interlock with the corresponding core channels when the cores and slats are assembled.

The number of grooves with each slat equals half the number of total channels provided on the surface of the core. Thus, there may be either an odd or even number of grooves.

The milling machine used to produce the grooves within the slat uses uniquely configured and precision made cutting blades to produce a substantially identical geometric configuration to that of the core. Specifically, after the diameters of the dried cores are determined, a cutting blade is selected that includes a major diameter no larger than 0.005" and preferably no larger than 0.001" of the major diameter of the color core.

In the preferred embodiment, the sides of each of the grooves produced by the cutting blades form a corresponding combined angle 13*a*2 or 15*a*2 (corresponding to angles

13*a*1 and 15*a*1, respectively) with the center line of the groove of at least about 90 degrees, to match the angled arrangement of a corresponding channels of the core.

When the slats have been cut, the dried and extruded cores are positioned within the grooves of one slat, with the grooves of the slats aligned to interlock with the corresponding channels of the core. A second slat is placed overtop the exposed cores to produce a sandwich 1. The sandwich 1 is then placed under pressure to lock the cores to the slats after assembly. The resultant lock between the cores and slats also lock the slats together.

A pressure process which may be used in the present invention may consist of a pair of rollers 20 and 22, which are separated by a distance slightly smaller than the unpressed sandwich. Thus, when the sandwich 1 is fed into one side of the rollers 20 and 22, the sandwich is pressed through to the other side of the rollers, pushing the grooves of the slat into the channels of each core and resulting in a sandwich having a thickness of approximately the distance between the rollers. By means of this pressure, the core and the slats are locked by virtue of their geometric configuration.

Although an adhesive may be used for added measure, it is not necessary. The channel-groove arrangement produces a slat and core combination that is so tightly bound that the sandwich cannot be separated without breaking the wood slats.

The method of manufacturing pencils and the configuration thereof creates a cost effective and tightly bound pencil where the core remains locked to the casing. The method and pencil configuration can be easily implemented using typical pencil manufacturing machinery and processes.

While several variations of the present invention for a pencil with a locking core are described in detail herein, it should be apparent that the disclosure and teachings of the present invention will suggest many other alternative designs to those skilled in the art. Accordingly, the present invention is not limited to the foregoing embodiments but is subject to various modifications within the scope and spirit of the claims.

What is claimed is:

1. A writing instrument comprising:

a core having a configuration including a longitudinal axis and an external surface with a plurality of channels spaced apart thereon, each said channel including a convex curved surface portion facing outwardly from said longitudinal axis and sides which form an angle of at least about 90 degrees at the centerline of each channel, wherein said channels include at least one pair of first channels each having a substantially flat side in a first plane and at least one pair of second channels each having a substantially flat side in a second plane substantially parallel to said first plane, said pair of second channels positioned about 180 degrees in the radial direction from said pair of first channels; and a pair of slats each having a configuration corresponding to approximately half of said configuration of said core.

2. A writing instrument according to claim 1, further comprising an adhesive.

3. A writing instrument according to claim 1, wherein said plurality of channels constitutes 8 channels.

4. A process for manufacturing a writing instrument, comprising the steps of:

preparing a core material having a predetermined moisture content;

extruding said core material to produce a configuration that includes a core having a configuration including a longitudinal axis and an external surface with a plurality of channels spaced apart thereon, each said channel including a convex curved surface portion facing outwardly from said longitudinal axis and sides which form an angle of at least about 90 decrees at the centerline of each channel, wherein said channels include at least one pair of first channels each having a substantially flat side in a first plane and at least one pair of second channels each having a substantially flat side in a second plane substantially parallel to said first plane, said pair of second channels positioned about 180 degrees in the radial direction from said pair of first channels preparing a pair of slats each to include a configuration corresponding to approximately half of said configuration of said core;

positioning said core between said slats to align said configuration of said core with said configurations of said slats; and pressing together said core and said slats.

5. A process for manufacturing a writing instrument according to claim 4, wherein the predetermined moisture content equals about 20–35% of the dry component weight of the core material.

6. A process for manufacturing a writing instrument according to claim 4, wherein the predetermined moisture content equals about 25–29% of the dry component weight of the core material.

7. A process for manufacturing a writing instrument according to claim 4, wherein the predetermined moisture content equals about 27% of the dry component weight of the core material.

8. A process for manufacturing a writing instrument according to claim 4, wherein said plurality of channels constitutes 8 channels.

9. A process for manufacturing a writing instrument according to claim 4, further comprising the steps of applying an adhesive between said slats and said core.

10. A writing instrument core for use in connection with slats comprising a configuration that includes a core having a configuration including a longitudinal axis and an external surface with a plurality of channels spaced apart thereon, each said channel including a convex curved surface portion facing outwardly from said longitudinal axis and sides which form an angle of at least about 90 degrees at the centerline of each channel, wherein said channels include at least one pair of first channels each having a substantially flat side in a first plane and at least one pair of second channels each having a substantially flat side in a second plane substantially parallel to said first plane, said pair of second channels positioned about 180 degrees in the radial direction from said pair of first channels.

11. A writing instrument core according to claim 10, wherein said plurality of channels constitutes 8 channels.

12. A slat for a writing instrument having a configuration that includes a plurality of spaced apart grooves, each said groove corresponding to approximately half of a core having a configuration including a longitudinal axis and an external surface with a plurality of channels spaced apart thereon, each said channel including a convex curved surface portion facing outwardly from said longitudinal axis and sides which form an angle of at least about 90 degrees at the centerline of each channel, wherein said channels include at least one pair of first channels each having a substantially flat side in a first plane and at least one pair of second channels each having a substantially flat side in a second plane substantially parallel to said first plane, said pair of second channels positioned about 180 degrees in the radial direction from said pair of first channels.

13. A pencil comprising:

a core having a configuration including a longitudinal axis and an external surface with a plurality of channels spaced apart thereon, each said channel including a convex curved surface portion facing outwardly from said longitudinal axis and sides which form an angle of at least about 90 degrees at the centerline of each channel, wherein said channels include at least one pair of first channels each having a substantially flat side in a first plane and at least one pair of second channels each having a substantially flat side in a second plane substantially parallel to said first plane, said pair of second channels positioned about 180 degrees in the radial direction from said pair of first channels; and a pair of slats each having a configuration corresponding to approximately half of said configuration of said core.

* * * * *

UNITED STATES PATENT AND TRADEMARK OFFICE

CERTIFICATE OF CORRECTION

PATENT NO. : 6,179,502 B1
DATED : January 30, 2001
INVENTOR(S) : Terry A. Gray

It is certified that error appears in the above-identified patent and that said Letters Patent is hereby corrected as shown below:

Title page,
Item [57], ABSTRACT,
Line 4, "thereof," should read -- thereof, includes --; and "includes" should be deleted.

Column 1,
Line 38, "variety" should read -- variety of --.

Column 6,
Line 13, "channels" should read -- channels; --.

Signed and Sealed this

First Day of July, 2003

JAMES E. ROGAN
*Director of the United States Patent and Trademark Office*